US005131643A

United States Patent [19]

Graveson et al.

[11] Patent Number: 5,131,643

[45] Date of Patent: Jul. 21, 1992

[54] CLAMPING ARM FOR ENVELOPE TURNER

[75] Inventors: Sandra J. Graveson; Joseph H. Marzullo, both of Waterbury; Christopher DeBarber, Woodbury; Michael D. Ballard, Sandyhook; Curtis L. Mrozinski, Newtown, all of Conn.

[73] Assignee: Pitney Bowes Inc., Stamford, Conn.

[21] Appl. No.: 738,988

[22] Filed: Aug. 1, 1991

[51] Int. Cl.[5] ..... B65H 9/06

[52] U.S. Cl. ..... 271/2; 271/184; 271/225; 271/245

[58] Field of Search ..... 271/2, 225, 184, 185, 271/245

[56] References Cited

U.S. PATENT DOCUMENTS 4,314,644 2/1982 Stocker ..... 271/225 X 5,074,544 12/1991 Kulpa ..... 271/225

*Primary Examiner*—Richard A. Schacher

*Attorney, Agent, or Firm*—Charles R. Malandra, Jr.; David E. Pitchenik; Melvin J. Scolnick

[57] ABSTRACT

Apparatus for turning an envelope, including: a housing; a transport deck secured to the housing for transporting an envelope from an upstream location to a downstream location, the deck including a device for moving the envelope; a vertically extending spindle located beneath the deck, the spindle being rotatable and reciprocable and having an upper end capable of extending above the transport deck; a device for raising and rotating the spindle; and a clamping arm assembly rotatably mounted to the housing situated above the transport deck, the clamping arm assembly having a device for applying a light, downward bias on the envelope against the upper end of the spindle, and a device for applying additional pressure to the envelope after the spindle is raised.

11 Claims, 7 Drawing Sheets

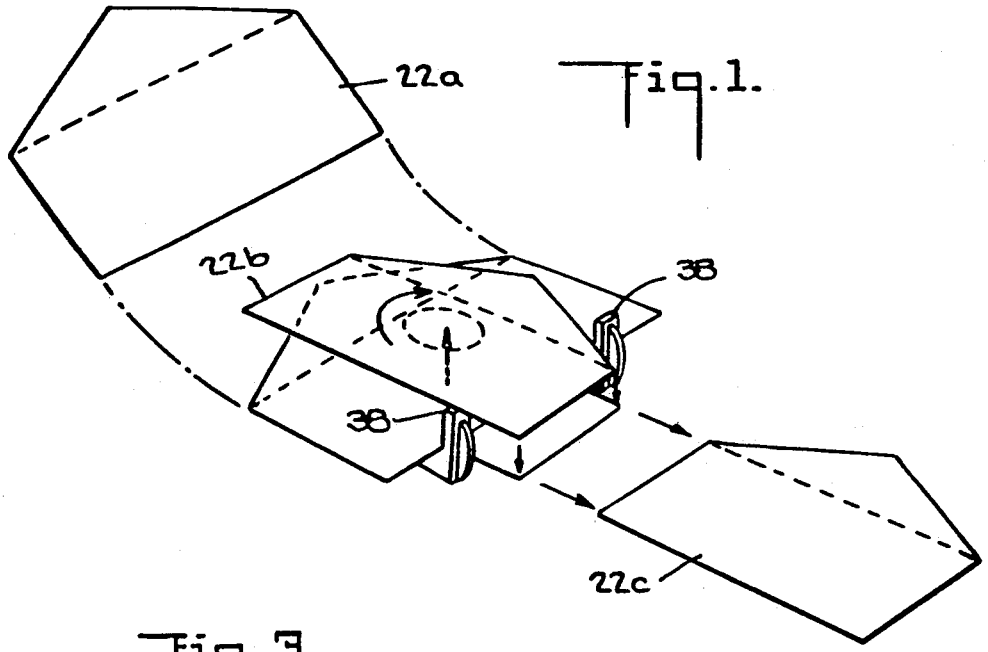
Fig. 1.
Fig. 3.
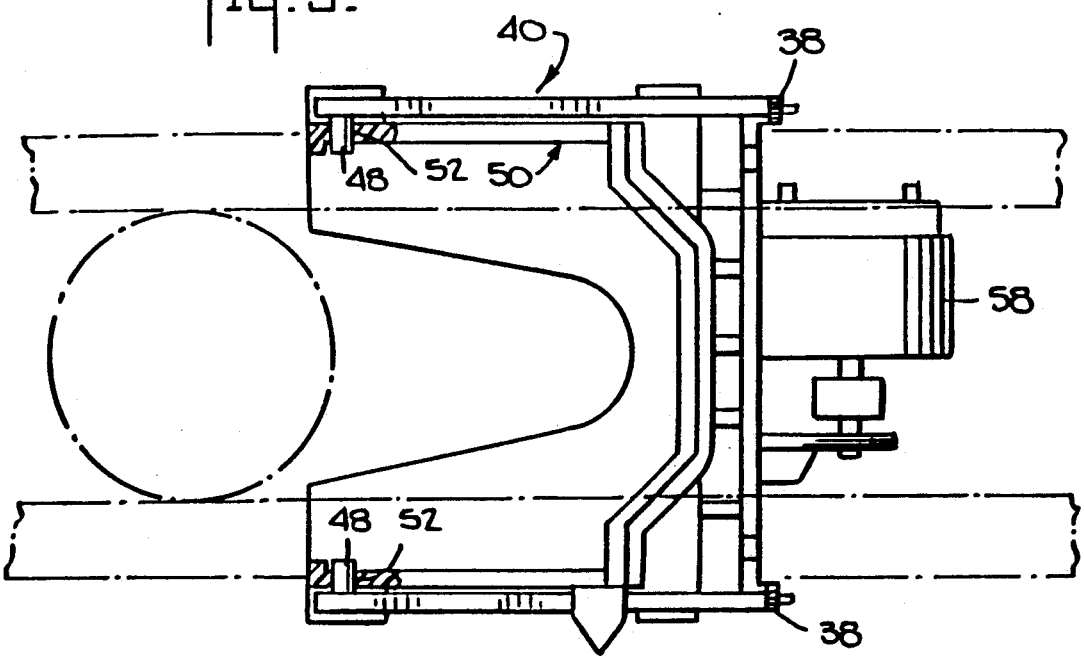

CLAMPING ARM FOR ENVELOPE TURNER

BACKGROUND OF THE INVENTION

The instant invention relates generally to apparatus for turning flat articles and is particularly related to apparatus for turning envelopes.

Turning devices for flat articles that are conveyed horizontally are required in mail processing machines. Examples of flat articles include envelopes, letters, postcards, endless forms issued by a computer controlled printing device that are cut into sheets from an endless web, and the like. In an inserter and mail processing machine, sheets are fed, one by one or collected together, to a folding station and subsequently, with or without additional enclosures, are conveyed to an inserting station where the sheets are inserted into an envelope.

After insertion of the sheets into the envelope, the stuffed envelope is forwarded to a postage station where postage is imprinted thereon by a postage meter or printer. In certain inserters, it is necessary to turn the stuffed envelopes through a 90 degree angle if the postage meter or printer is oriented in the same direction as the discharge from the inserting station. Many types of turners are known in the prior art to effect a 90 degree turn, including the turner disclosed in U.S. Pat. No. 4,928,807 issued to the assignee of the instant invention. In the '807 patent, a spring loaded pivot ball is used to clamp the envelope being turned against an elastomeric disk situated beneath the envelope. It has been found that the '807 clamping mechanism would not clamp properly over the entire range of envelope pack thicknesses. Excessive forces were generated on the turner deck and helped cause excessive belt and turner deck wear and increased system amperge which affected motor function.

Accordingly, the instant invention was developed and provides a clamping arm which overcomes all of the problems associated with the '807 clamping mechanism.

SUMMARY OF THE INVENTION

The instant invention provides apparatus for turning an envelope. The apparatus includes: a housing; a transport deck secured to the housing for transporting an envelope from an upstream location to a downstream location, the deck including means for moving the envelope; a vertically extending spindle located beneath the deck, the spindle being rotatable and reciprocable and having an upper end capable of extending above the transport deck; means for raising and rotating the spindle; and a clamping arm assembly rotatably mounted to the housing situated above the transport deck, the clamping arm assembly having means for applying a light, downward bias on the envelope against the upper end of the spindle, and means for applying additional pressure to the envelope after the spindle is raised.

BRIEF DESCRIPTION OF THE DRAWINGS

FIG. 1 is a perspective view of an envelope being turned;

FIG. 3 is a top, plan view of the envelope turning machine seen in FIG. 2;

FIG. 6 is similar to FIG. 5 except that the envelope has been turned and is being ejected from the turning machine;

DETAILED DESCRIPTION OF THE PREFERRED EMBODIMENT

Figure 2:
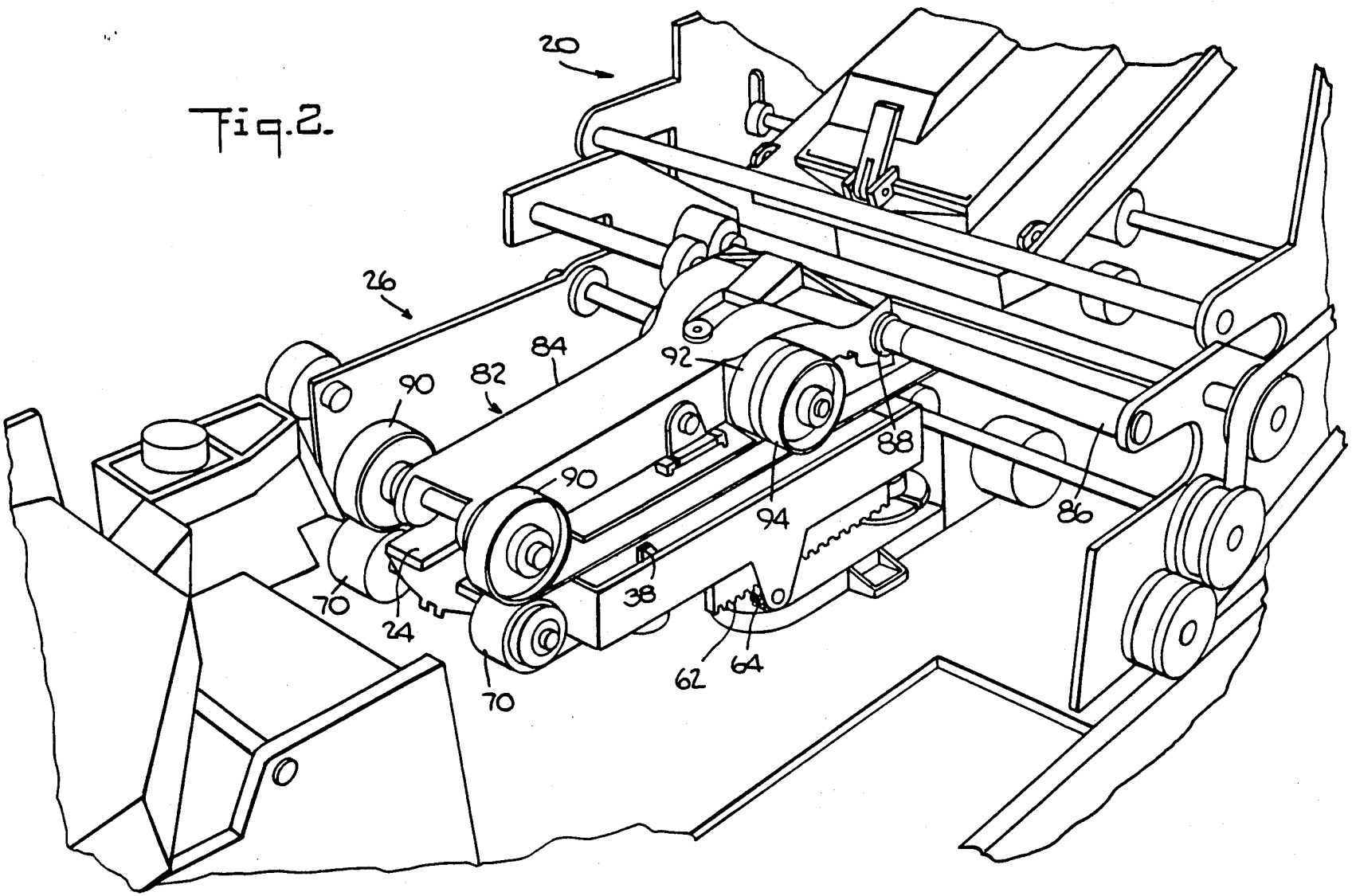
FIG. 2 is a perspective view of an envelope turning machine employing a clamping arm in accordance with the instant invention.
Figure 4:
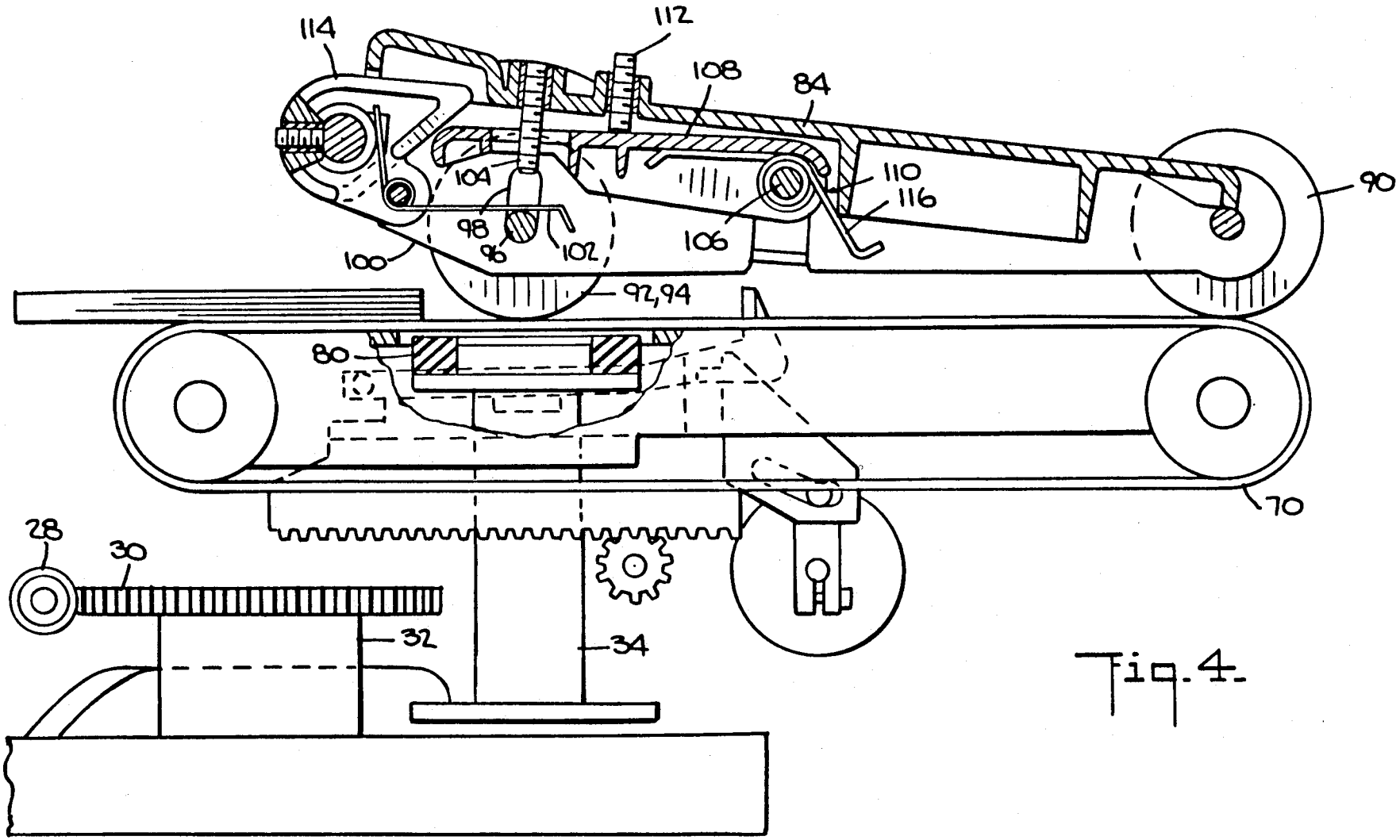
FIG. 4 is a vertical, sectional view of the machine seen in FIG. 2 showing an envelope about to enter the turning machine.

In describing the preferred embodiment of the instant invention, reference is made to the drawings, wherein there is seen in FIG. 2 a table-top inserter generally designated 20 which feeds and inserts documents (not seen) into an envelope 22. The stuffed envelope 22 is then fed onto a feed deck 24 of an envelope turning apparatus generally designated 26.

As seen in FIG. 1, the envelopes 22 are initially fed from the inserter 20 in the alignment manifested by envelope 22*a*, i.e. the length of the envelope 22 is perpendicular to the direction of travel. Envelope 22*b* represents an envelope that has been turned by the turner 26, and envelope 22*c* represents an envelope that has been ejected from the turner 26.

When an envelope 22 has been filled with inserted documents by the inserter 20 and sensors determine that the proper documents have been inserted, a pair of registration stop fingers 38 are raised into the position seen in FIGS. 1 and 4–6, and the envelope 22 is released by the inserter 20. The envelope 22 is fed to the position seen in FIG. 4 and then to the position seen in FIG. 5 where it is stopped and aligned by the registration stops 38. Once the envelope 22 is resting against the stops 38, it is ready to be turned 90 degrees. A worm 28 drives a worm wheel 30 which is secured to a multi-function cam 32, which is rotated 360 degrees. Through this rotation, a spindle/geneva 34 is raised 0.40 inch and rotated 90 degrees. The 90 degree rotation turns the envelope 22 to align with a sealing device (not shown) downstream. A pair of continuously running feed belts 70 feed the envelope 22 through the turner 26.

The stop fingers 38 are part of a yoke 40 (see FIG. 3) which is secured to a carriage 50 by means of a pair of studs 48 engaging a pair of mating apertures 52 in the carriage 50, which is secured to the turner feed deck 24.

A rubber cap 80 is secured to the top of the spindle 34 and cooperates with a clamping arm assembly generally designated 82 to turn the envelope 22 through a 90 degree rotation. The clamping arm assembly 82 includes a frame 84 rotatably mounted at its upstream end on a shaft 86 and biased downwardly by a pair of torsion springs 88 which provide a degree of pinch on a pair of output rollers 90.

The clamping arm assembly 82 includes a pair of inside rollers 92 which clamp the stuffed envelope 22 against the rubber cap 80, and a pair of outside rollers 94 which combine with the feed belts 70 therebelow to drive the stuffed envelope 22 downstream and out of the turner 26 for further processing, such as sealing. The rollers 92 and 94 are rotatably mounted on a shaft 96 which rides up and down in a pair of slots 98 situated in a pair of flanges 100 on the underside of the frame 84.

A light, urge torsion spring 102 (to be discussed further hereinbelow) provides a light, downward bias on the roller shaft 96 which in turn maintains a light, downward bias on the rollers 92 and 94 which prevents incoming, stuffed envelopes 22 from jumping over the stops 38 and provides a drive for the envelope 22 to reach the stops 38.

A set screw 104 threadingly engages the top side of the frame 84 and functions as a limiting stop for the shaft 96. A shaft 106 extends between the sides of the frame 84 about midway between the upstream and downstream ends. A tensioner member 108 is rotatably mounted on the shaft 106 at the downstream end and a torsion, clamp spring 110 also mounted on the shaft 106 urges the tensioner member 108 against a set screw 112 seated in the top side of the frame 84. Fixedly mounted on the shaft 86 is a stopping member 114 on which is mounted the urge spring 102.

Figure 5:
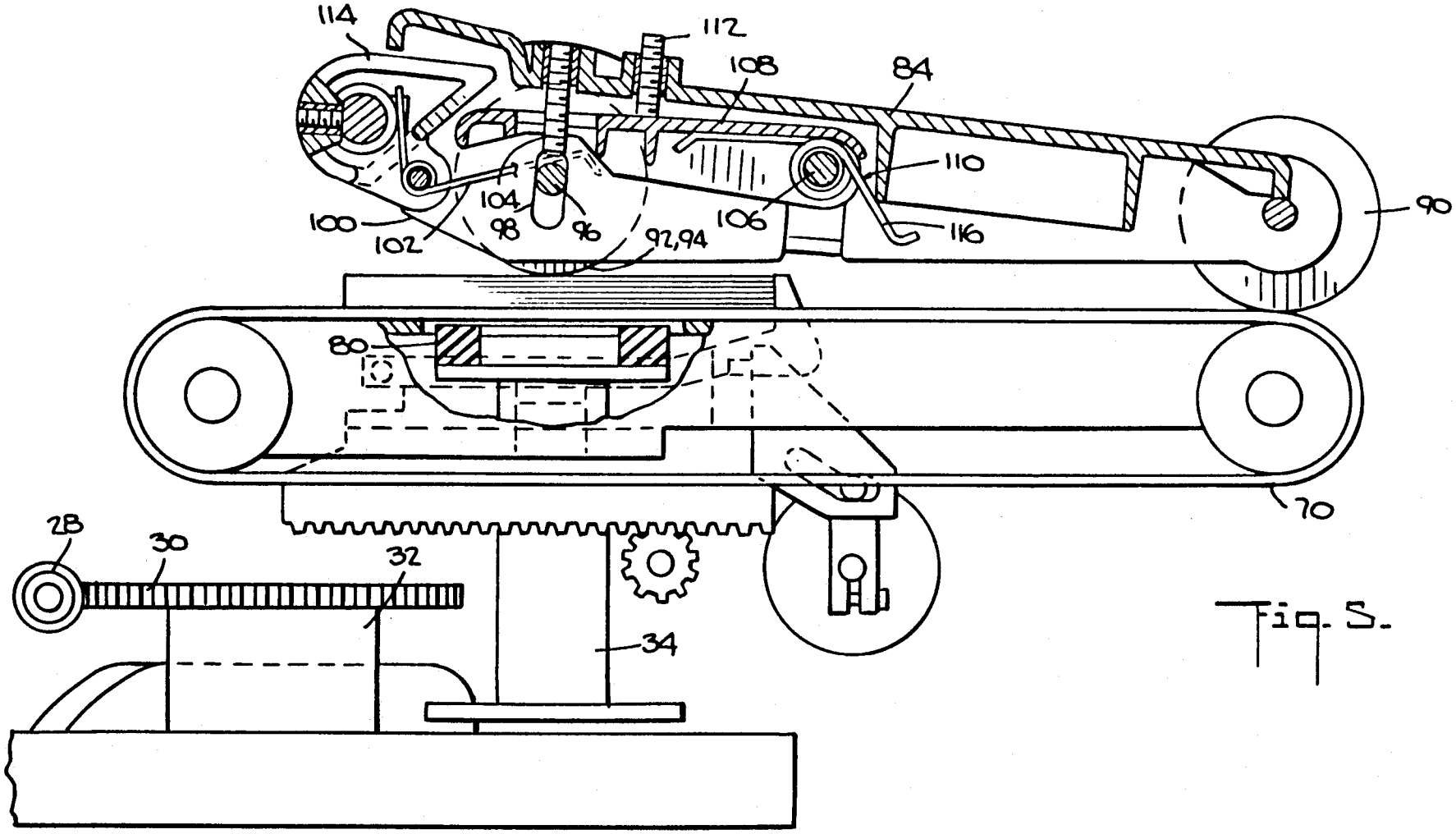
FIG. 5 is a vertical, sectional view of the machine seen in FIG. 2 showing an envelope being stopped and aligned prior to being turned.
Figure 5:
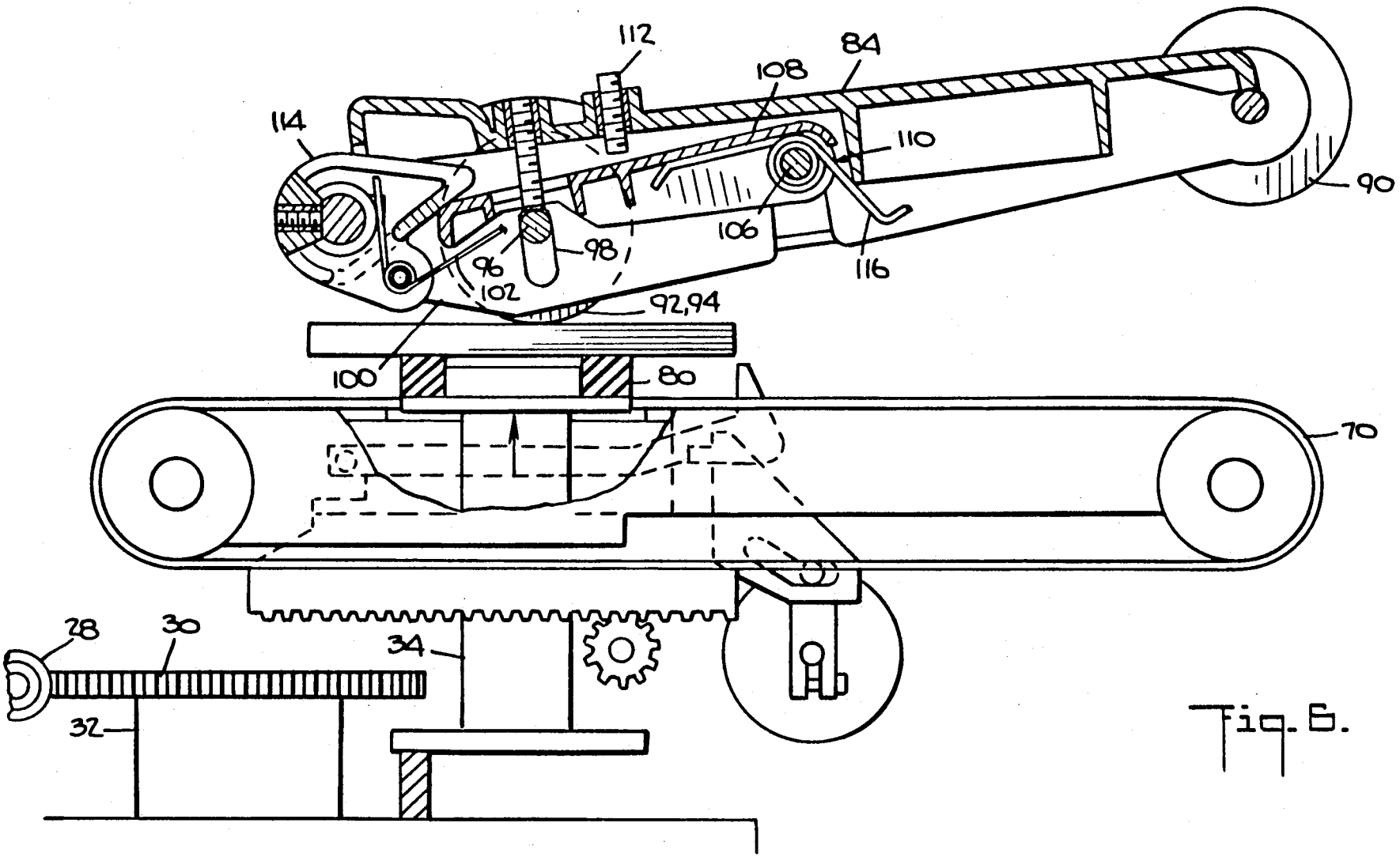
Figure 7:
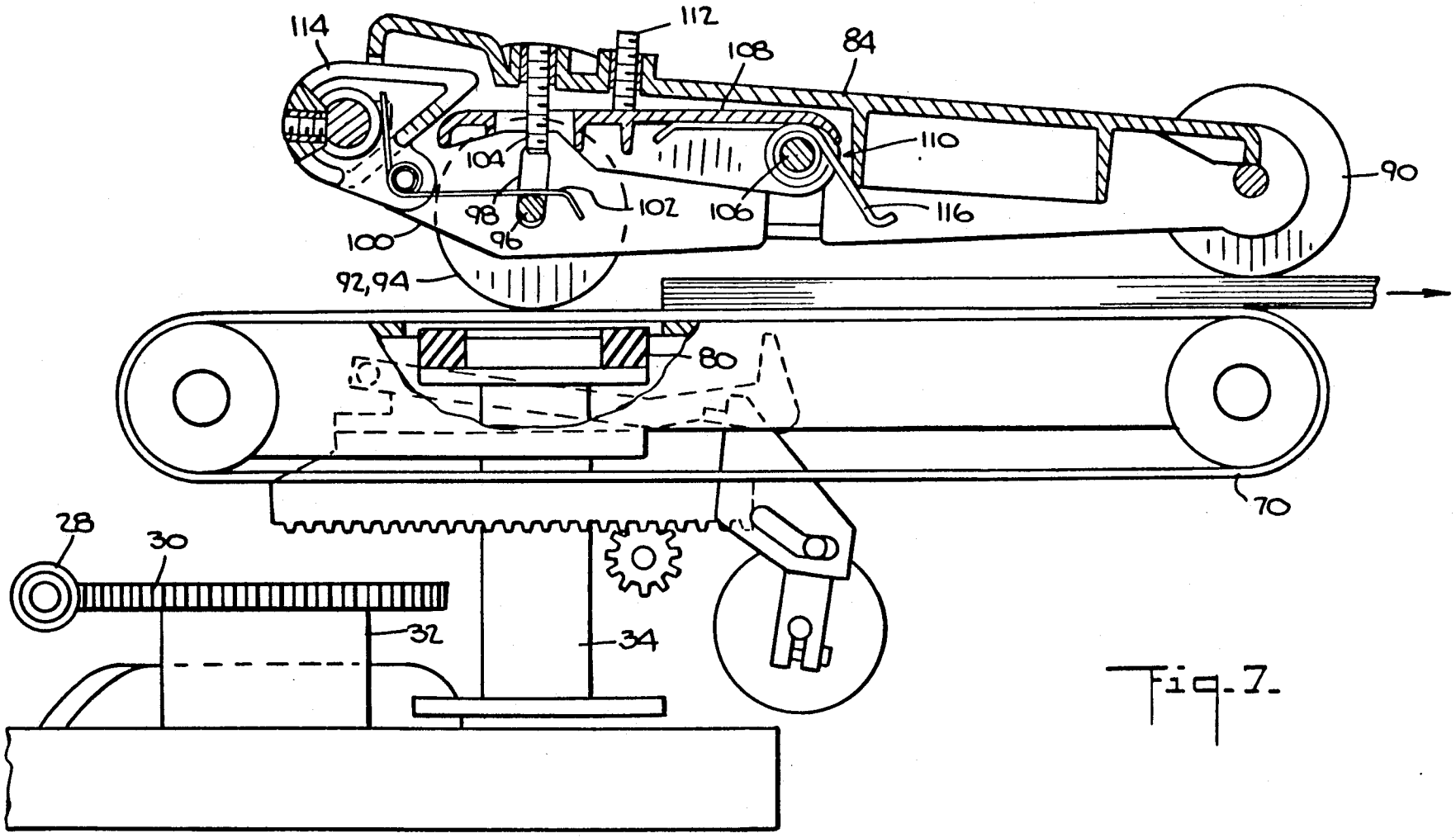
FIG. 7 is similar to FIG. 6 except that the envelope is being fed away from the turning machine.
Figure 8:
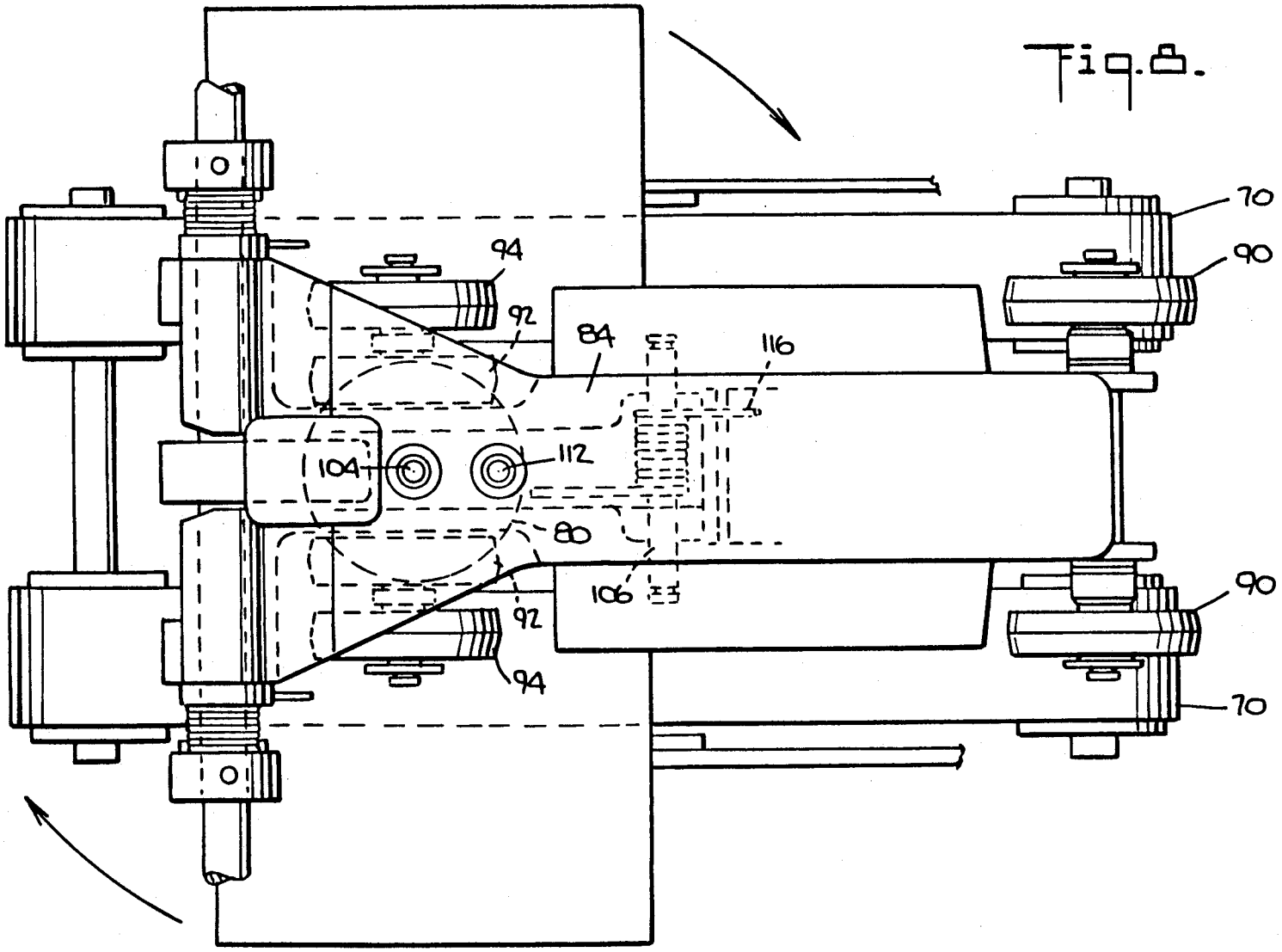
FIG. 8 is a top, plan view of the clamping arm seen in FIGS. 4–7.

In operation, when a stuffed envelope 22 is stopped by the registration stops 38, as seen in FIG. 5, the rollers 92 and 94 are forced upward, and because of the spring 102 providing a downward bias on the shaft 96, there is a slight downward pressure on the rollers 92 and 94 against the envelope 22. Once the spindle 34 is elevated against the opposing rollers 92, the shaft 96 presses upward against the set screw 104 which causes the frame 84 to rotate on the shaft 88 counterclockwise to the position seen in FIG. 6. The counterclockwise rotation of the frame 84 causes the upstream end of the tensioner 108, which, when the arm assembly 82 is in the down position (seen in FIG. 4) is spaced apart from the stopping member 114, to engage and abut against the stopper 114.

As a result of the counterclockwise rotation of the frame 84, the tensioner 108 rotates counterclockwise which tightens the spring 110, thereby increasing the tension in the spring 110, which includes a leg 116. The increased tension in the leg 116 creates an additional force on the frame 84 where it contacts the leg 116 which acts upward against the frame 84. Because the shaft 106 supporting the spring 110 is mounted on the arm 84, the shaft 106 functions as a pivot and the upward force on the frame 84 to the right of the shaft 106 is translated into a downward force on the frame 84 on the left side of the shaft 106. Thus, an additional downward force is generated on the set screw 104 (threaded on the left side of the frame 84) which is transmitted to the shaft 96 and then to the rollers 92 which oppose the spindle 34.

When the envelope 22 has been turned, i.e., the spindle 34 has completed its 90 degree rotation, the spindle 34 is lowered and the drive rollers 94 urge the turned envelope 22 toward a pair of eject rollers 118 which feed the envelope 22 downstream for further processing, such as sealing.

It can be seen from the foregoing that the full pressure requisite for turning the envelope 22 is not developed until the envelope 22 is actually about to be turned. Thus, the feed deck 24 and the belts 70, which run continuously, are saved from a substantial amount of wear and tear.

It should be understood by those skilled in the art that various modifications may be made in the present invention without departing from the spirit and scope thereof, as described in the specification and defined in the appended claims.

What is claimed is:

1. Apparatus for turning an envelope, comprising:

a housing;

a transport deck secured to said housing for transporting an envelope from an upstream location to a downstream location, said deck including means for moving said envelope;

a vertically extending spindle located beneath said deck, said spindle being rotatable and reciprocable and having an upper end capable of extending above said transport deck;

means for raising and rotating said spindle; and a clamping arm assembly rotatably mounted to said housing situated above said transport deck, said clamping arm assembly including i. means for applying a light, downward bias on said envelope against said upper end of said spindle; and ii. means for applying additional pressure to said envelope after said spindle is raised.

2. The apparatus of claim 1, additionally comprising means for stopping and aligning said envelope at a predetermined location.

3. The apparatus of claim 2, wherein said housing includes a first shaft and said clamping arm assembly includes a frame rotatably mounted at its upstream end on said first shaft.

4. The apparatus of claim 3, wherein said clamping arm assembly additionally includes a second shaft mounted on said frame about midway between the upstream and downstream ends of said frame and a tensioner member pivotably mounted on said second shaft.

5. The apparatus of claim 4, additionally including a stopping member fixedly mounted on said first shaft adjacent but spaced from the upstream end of said tensioner member.

6. The apparatus of claim 5, wherein said frame includes a vertically extending slot, and said clamping arm assembly includes a third shaft mounted in said slot and a roller rotatably mounted on said third shaft.

7. The apparatus of claim 6, additionally comprising a pair of eject rollers rotatably mounted at the downstream end of said frame.

8. The apparatus of claim 7, additionally comprising means for providing a downward force on said eject rollers.

9. The apparatus of claim 8, wherein said light downward bias means comprises a first torsion spring mounted on said frame and engaging said third shaft.

10. The apparatus of claim 9, wherein said additional pressure applying means comprises a second torsion spring mounted on said second shaft, whereby when said upper end of said spindle is extended above said transport deck, said clamping arm assembly is rotated counterclockwise about said first shaft and said tensioner member is rotated counterclockwise about said second shaft and abuts said stopping member to thereby apply additional pressure to said envelope when said spindle is rotated.

11. The apparatus of claim 10, wherein said means for providing a downward force on said eject rollers comprises a third torsion spring mounted on said first shaft and engaging said upstream end of said frame.

* * * * *